US009818591B2

(12) United States Patent
Schwieters et al.

(10) Patent No.: US 9,818,591 B2
(45) Date of Patent: Nov. 14, 2017

(54) MIRROR LENS FOR DIRECTING AN ION BEAM

(71) Applicant: Thermo Fisher Scientific (Bremen) GmbH, Bremen (DE)

(72) Inventors: Johannes Schwieters, Ganderkesee (DE); Gerhard Jung, Delmenhorst (DE)

(73) Assignee: Thermo Fisher Scientific (Bremer) GmbH, Bremen (DE)

( * ) Notice: Subject to any disclaimer, the term of this patent is extended or adjusted under 35 U.S.C. 154(b) by 0 days.

(21) Appl. No.: 15/227,269

(22) Filed: Aug. 3, 2016

(65) Prior Publication Data

US 2017/0047216 A1 Feb. 16, 2017

(30) Foreign Application Priority Data

Aug. 14, 2015 (GB) ..... 1514479.3

(51) Int. Cl.
*H01J 49/00* (2006.01)
*H01J 49/06* (2006.01)

(52) U.S. Cl.
CPC ..... *H01J 49/061* (2013.01)

(58) Field of Classification Search
CPC ..... H01J 49/00; H01J 49/061
USPC ... 250/281, 282, 286, 288, 290, 396 R, 398, 250/400
See application file for complete search history.

(56) References Cited

U.S. PATENT DOCUMENTS

| | | | |
|---|---|---|---|
| 5,049,739 | A | 9/1991 | Okamoto |
| 5,559,337 | A | 9/1996 | Ito et al. |
| 8,796,620 | B2 | 8/2014 | Shaw et al. |
| 8,921,803 | B2 | 12/2014 | Welkie |
| 9,048,078 | B2 | 6/2015 | Kalinitchenko |

FOREIGN PATENT DOCUMENTS

| | | | |
|---|---|---|---|
| EP | 0813228 | B1 | 7/2002 |
| EP | 1470667 | B1 | 2/2015 |
| GB | 2440800 | B | 9/2011 |
| WO | WO9725737 | A1 | 7/1997 |
| WO | WO2004059693 | A3 | 11/2005 |
| WO | WO2010080850 | A1 | 7/2010 |

(Continued)

OTHER PUBLICATIONS

Douglas, "Some Current Perspectives on ICP-MS," Canadian Journal Spectroscopy, 34(2), 38-49, 1989.

(Continued)

*Primary Examiner* — Nicole Ippolito
*Assistant Examiner* — Hanway Chang
(74) *Attorney, Agent, or Firm* — A. J. Gokcek

(57) ABSTRACT

An electrostatic dual-mode lens assembly is provided for selectively transmitting or reflecting an ion beam in a mass spectrometer. The assembly comprises at least one electrode that provides a switchable electric field that, during a first mode of operation, directs an ion beam that enters the assembly along a first path so that the beam is transmitted through the assembly along the first path, and during a second mode of operation, directs an ion beam that enters the assembly along the first path so that the ion beam is reflected by the electric field and exits the assembly along a second path. Methods for operating a mass spectrometer using an electrostatic lens are also provided.

26 Claims, 5 Drawing Sheets

(56) References Cited

FOREIGN PATENT DOCUMENTS

| | | | |
|---|---|---|---|
| WO | WO2011106768 | A1 | 9/2011 |
| WO | WO2014066362 | A3 | 7/2015 |

OTHER PUBLICATIONS

Eiden et al., "Selective Removal of Plasma Matrix Ions in Plasma Source Mass Spectrometry," J. Anal. At. Spec., 11, 317-322, 1996.
Hattendorf et al., "Suppression of in-cell generated interferences in a reaction cell ICP-MS by bandpass tuning and kinetic energy discrimination," J. Anal. At. Spectrom., 19, 600-606, 2004.
Koppenaal et al., "Collision and reaction cells in atomic mass spectrometry: development, status, and applications," J. Anal. At. Spectrom., 19, 561-570, 2004.
Tanner et al., "Reaction cells and collision cells for ICP-MS: a tutorial review," Spectrochimica Acta Part B, 57, 1361-1452, 2002.
Weyer et al., "High precision Fe isotope measurements with high mass resolution MC-ICPMS," Int. J. Mass Spec., 226, 355-368, 2003.

MIRROR LENS FOR DIRECTING AN ION BEAM

STATEMENT RELATING TO FUNDING

The work leading to this invention has received funding from the European Research Council under the European Union's Seventh Framework Programme (FP7/2007-2013)/ERC grant agreement n° FP7-GA-2013-321209.

CROSS-REFERENCE TO RELATED APPLICATION

This application claims the priority benefit under 35 U.S.C. §119 to British Patent Application No. 1514479.3, filed on Aug. 14, 2015, the disclosure of which is incorporated herein by reference.

FIELD

The invention relates to an electrostatic lens, in particular a lens for use with a mass spectrometer. The invention furthermore relates to methods of mass spectrometry, in particular inductively coupled mass spectrometry (ICP-MS).

INTRODUCTION

Mass spectrometry is an analytical method for qualitative and quantitative determination of molecular species present in samples, based on the mass to charge ratio and abundance of gaseous ions.

In inductively coupled plasma mass spectrometry (ICP-MS), atomic species can be detected with high sensitivity and precision, at concentrations as low as 1 in $10^{15}$ with respect to a non-interfering background. In ICP-MS, the sample to be analyzed is ionized with an inductively coupled plasma and subsequently separated and quantified in a mass analyzer.

Precise and accurate isotope ratio measurements very often provide the only way to gain deeper insight into scientific questions which cannot be answered by any other analytical technique. Multicollector ICP-MS is an established method for high precision and accurate isotope ratio analysis. Applications of ICP-MS are in the field of geochronology, geochemistry, cosmochemistry, biogeochemistry, environmental sciences as well as in life sciences. However, elemental and molecular interferences in the mass spectrometer can limit the attainable precision and accuracy of the analysis.

These interferences can be present in the sample material itself or are generated by sample preparation from a contamination source, such as chemicals used, sample containers, or by fractionation during sample purification. Contaminating species can also be generated in the ion source or in the mass spectrometer.

In order to achieve high precision and accurate isotope ratio measurements, extended physical and chemical sample preparation is applied to get clean samples free from possible interferences and contamination that can interfere in the mass spectrum. Typical concentrations of analyte in sample material used in isotope ratio ICP-MS are in the range of parts per billion. The analyte of interest may also be concentrated in small inclusions or crystals within a heterogeneous sample material, for example in rock samples.

Extended quality control steps are integrated into the sample preparation to ensure that the sample preparation itself does not lead to changes in the isotope ratio of the sample material. Every sample preparation step comes along with the possibility of adding contamination to the samples and/or causing isotopic fractionation of the analyte to be extracted from the original sample material, which could be for instance a rock, a crystal, soil, a dust particle, a liquid and/or organic matter. Even if all these steps are taken with great care there still is the chance of contamination and incomplete separation and interferences in the mass spectrum.

Ideally one would like to completely avoid the chemical sample preparation step. Moreover a chemical sample preparation is impossible if a laser is used to directly ablate the sample and flush the ablated material into the ICP source. In such cases, there is no chemical separation of the desired analyte from the sample matrix and all the specificity has to come from the mass analyzer and the sample introduction system in the mass analyzer. Specificity describes the ability of an analyzer to unambiguously determine and identify a certain species in a sample. One way to achieve specificity in a mass spectrometer is to ensure that the mass resolving power $M/(\Delta M)$ of the mass analyzer is large enough to clearly separate one species from another species where $\Delta M$ is meant to be the mass difference of both species and M is the mass of the species of interest. This requires very high mass resolution in case of isobaric interferences of species with the same nominal mass. For sector field mass spectrometers high mass resolution comes along with using very narrow entrance slits to the mass analyzer and the small entrance slits significantly reduce the transmission and thus the sensitivity of the mass analyzer. As a consequence, this becomes an unpractical approach where very high mass resolving power is required. This is a special challenge for mass spectrometry instrumentation where current technical solutions are limited.

The Inductively Coupled Plasma (ICP) ion source is a very efficient ion source for elemental and isotopic analysis using mass spectrometry. This is an analytical method that is capable of detecting elements at very low concentration, as low as one part in $10^{15}$ (part per quadrillion, ppq) on non-interfered low-background isotopes. The method involves ionizing the sample to be analyzed with an inductively coupled plasma and then using a mass spectrometer to separate and quantify the thus generated ions.

Ionizing a gas, usually argon, in an electromagnetic coil, to generate a highly energized mixture of argon atoms, free electrons and argon ions, generates the plasma, in which the temperature is high enough to cause atomization and ionisation of the sample. The ions produced are introduced, via one or more stages of pressure reduction, into a mass analyzer which is most commonly a quadrupole analyzer, a magnetic sector analyzer or a time-of-flight analyzer.

High precision mass analyzers allow for high mass resolution to separate elemental ions from molecular species which to some extent are inevitably formed inside the ICP source (e.g. $OH^+$, $NO^+$, $CO^+$, $CO_2^+$, $ArO^+$, $ArN^+$, $ArAr^+$, etc.) and interfere with elemental ions. Thus, certain elements are known to have relatively poor detection limits by ICP-MS. These are predominantly those that suffer from artefacts or spectral interferences generated by ions that are derived from the plasma gas, matrix components or the solvent used to solubilize samples. Examples include $^{40}Ar^{16}O$ for determination of $^{56}Fe$, $^{38}ArH$ for determination of $^{39}K$, $^{40}Ar$ for determination of $^{40}Ca$, $^{40}Ar^{40}Ar$ for determination of $^{80}Se$, $^{40}Ar^{35}Cl$ for determination of $^{75}As$, $^{40}Ar^{12}C$ for determination of $^{52}Cr$ and $^{35}Cl^{16}O$ for determination of $^{51}V$.

With a high mass resolution magnetic sector multicollector mass spectrometer the molecular species can be separated along the focal plane of the mass spectrometer so that just the elemental ions can be detected while the molecular interferences are discriminated at the detector slit (see Weyer & Schwieters, International Journal of Mass Spectrometry, Vol. 226, Number 3, May 2003, herein incorporated by reference). This procedure works well for interferences where the relative mass deviation between the analyte and the interference is in the range of $(M/\Delta M)<2{,}000\text{-}10{,}000$ (M: mass of the analyte, ΔM: mass difference between analyte and interference).

With a sector mass spectrometer high mass resolution usually comes along with reduced ion optical transmission into to the mass analyzer because high mass resolution requires narrower entrance slits and smaller apertures to minimize second or third order angular aberrations further down the ion beam path from the entrance slit to the detector. In the particular case where the amount of sample is limited or the analyte concentration in a sample is low the reduced sensitivity in high mass resolution mode is a significant problem. It directly results in reduced analytical precision because of poorer counting statistics at effectively reduced transmission through the sector field analyzer. Therefore high mass resolution is not generally a practical solution to eliminate interferences and to gain specificity even in cases where the mass resolving power of the mass spectrometer would be sufficient to discriminate the interferences.

There are other applications where isobaric interferences of elemental ions cannot be avoided by sample preparation and where mass resolving power >>10,000 would be required to separate the interfering species. One example is the analysis of $^{40}Ca$ with argon based plasma. There is a strong interference of elemental $^{40}Ar^+$ on $^{40}Ca^+$. The required mass resolution to separate both species would be >193,000 which is much greater than that which can be achieved by a magnetic sector field analyzer.

One solution to this problem is provided by collision cell technology (ICP-CCT) that includes a collision/reaction cell that is positioned before the analyzer. This collision cell adds another possibility to achieve specificity for the analysis. Instead of mass resolving power it uses chemical reactions to distinguish between interfering species. Into this cell, which typically comprises a multipole operating in a radiofrequency mode to focus the ions, a collision gas such as helium or hydrogen is introduced. The collision gas collides and reacts with the ions in the cell, to convert interfering ions to harmless non-interfering species.

A collision cell may be used to remove unwanted artefact ions from an elemental mass spectrum. The use of a collision cell is described, e.g., in EP 6 813 228 A1, WO 97/25737 or U.S. Pat. No. 5,049,739 B, all herein incorporated by reference. A collision cell is a substantially gas-tight enclosure through which ions are transmitted. It is positioned between the ion source and the main mass analyzer. A target gas (molecular and/or atomic) is admitted into the collision cell, with the objective of promoting collisions between ions and the neutral gas molecules or atoms. The collision cell may be a passive cell, as disclosed in U.S. Pat. No. 5,049,739 B, or the ions may be confined in the cell by means of ion optics, for example a multipole which is driven with alternating voltages or a combination of alternating and direct voltages, as in EP 0 813 228. By this means the collision cell can be configured so as to transmit ions with minimal losses, even when the cell is operated at a pressure that is high enough to guarantee many collisions between the ions and the gas molecules.

For example, the use of a collision cell where about 2% $H_2$ is added to He gas inside the cell selectively neutralizes $^{40}Ar^+$ ion by low energy collisions of the $^{40}Ar^+$ with the $H_2$ gas and a resonant charge transfer of an electron from the $H_2$ gas to neutralize the $^{40}Ar^+$ ions (see Tanner, Baranov & Bandura, 2002, Spectrochimica Acta Part B: Atomic Spectroscopy, 57:1361-1452, herein incorporated by reference). This charge transfer mechanism is very selective and efficiently neutralizes argon ions and thus discriminates $^{40}Ar^+$ ions from $^{40}Ca^+$. These types of effects are sometimes called chemical resolution (Tanner & Holland, 2001, in: Plasma Source Mass Spectrometry: The New Millennium, Publisher: Royal Soc of Chem) in comparison to mass resolution in the case of mass spectrometer.

In addition to the charge transfer reaction other mechanisms inside the collision cell using other collision gases or mixtures of collision gases may be applied to reduce interferences. These mechanisms include: kinetic energy discrimination due to collisions inside the collision cell (e.g., Hattendorf & Guenther, 2004, J. Anal Atom Spectroscopy 19:600), herein incorporated by reference), fragmentation of molecular species inside the collision cell (see Koppenaal, D., W., Eiden, G., C. and Barinaga, C., J., (2004), *Collision and reaction cells in atomic mass spectrometry: development, status, and applications*, Journal of Analytical Atomic Spectroscopy, Volume 19, p.: 561-570 herein incorporated by reference), and/or mass shift reactions inside the collision cell. This toolbox of ICP-CCT can come closer to the goal of detection specificity using direct sample analysis with significantly reduced sample preparation but there are still analytical problems and interferences which cannot be resolved by interfacing a collision cell to a mass spectrometer.

By careful control of the conditions in the collision cell, it is possible to transmit the desired ions efficiently. This is possible because in general the desired ions, those that form part of the mass spectrum to be analyzed, are monatomic and carry a single positive charge that is, they have lost an electron. If such an ion collides with a neutral gas atom or molecule, the ion will retain its positive charge unless the first ionisation potential of the gas is low enough for an electron to transfer to the ion and neutralise it. Consequently, gases with high ionisation potentials are ideal target gases. Conversely, it is possible to remove artefact ions while continuing to transmit the desired ions efficiently. For example the artefact ions may be molecular ions such as $ArO^+$ or $Ar_2^+$ which are much less stable than the atomic ions. In a collision with a neutral gas atom or molecule, a molecular ion may dissociate, forming a new ion of lower mass and one or more neutral fragments. In addition, the collision cross section for collisions involving a molecular ion tends to be greater than for an atomic ion. This was demonstrated by Douglas (Canadian Journal Spectroscopy, 1989 vol 34(2) pp 36-49), incorporated herein by reference. Another possibility is to utilise reactive collisions. Eiden et al. (Journal of Analytical Atomic Spectrometry vol 11 pp 317-322 (1996)) used hydrogen to eliminate many molecular ions and also $Ar^+$, while monatomic analyte ions remain largely unaffected.

For analysis of samples with unknown elemental composition, and in particular for samples with unknown and/or exotic isotope composition, it can be useful to obtain a full mass spectrum of the sample, to assess its elemental composition and thereby obtain information about possible interferences, as well as making isotope ratio determinations for selected masses. For example, samples with extreme or unusual isotopic ratio can typically be found in extraterrestrial samples like meteorites or in nuclear samples that have been artificially enriched. Methods known in the art for doing so require the use of two mass analyzers, one that determines the full spectrum and another that determines isotope ratios in a predetermined range.

Ion deflectors and lenses are known in the art. For example, electrostatic lenses are widely used to control and direct ion beams with various energy and directions, especially in electron microscopy.

U.S. Pat. No. 9,048,078 discloses an ion deflector for use with a mass spectrometer, for directing a flow of ions between two axes of travel. The deflector includes an electric field capable of causing a flow of ions focused through a first spatial region to be focused toward a second spatial region, whereby the first and second spatial regions are aligned with respective axes of travel.

EP1470567 discloses an integrated ion focusing and gating lens for use in an ion trap mass spectrometer that includes first and second members of combined generally cylindrical configuration with the members focusing an ion beam along an axis of the generally cylindrical configuration when biased with the same voltage on each member, and the members deflecting an ion beam when the members are biased with different voltages. In a preferred embodiment, the first and second members are identical in configuration.

U.S. Pat. No. 8,921,803 discloses a system that includes an electrostatic lens in a path between a charged particle source and a detector, the lens including a first electrode having a first aperture in the path aligned with a first axis; a second electrode in the path between the first electrode and the detector, having a second aperture in the path and aligned with a second axis that is parallel to the first axis and displaced from the first axis along a first direction; a third electrode in the path between the first electrode and the second electrode; and a potential generator coupled to the electrodes.

U.S. Pat. No. 8,796,620 discloses a system to inhibit a sightline from a charged particle source to an analyzer and for changing a baseline offset of an output spectrum an analyzer. A supply of charged particles is directed through a hollow body of a deflector lens that is positioned relative to a charged particle source and an analyzer. A flow path through a deflector lens permits passage of the ions from the source to the detector while inhibiting a sightline from the detector to the source in a direction parallel to the central longitudinal axis of the deflector lens.

GB 2440800 discloses an instrument to monitor the isotopic and elemental composition of a sample. A multiple collector ICP mass spectrometer is modified so that ions are deflected from the main path into a secondary analyzer, such as a time-of-flight analyzer, by applying a pulsed signal to a deflector. As such, the majority of the ions still pass into the isotope analyzer, while small proportions are available for elemental analysis.

U.S. Pat. No. 5,559,337 discloses an ion lens with a deflector for deflecting an ion beam by 90°. The side of the deflector opposite the sampling interface is provided with an opening. Also, a correction electrode having at least a pair of elements is interposed between the deflector and a mass filter.

SUMMARY

The present invention addresses ways to facilitate the collection of a broad range of data in mass spectrometers, such as high resolution multicollector ICP-MS instruments, by use of a dual-function ion reflection lens.

The present invention provides an electrostatic dual-mode lens assembly for selectively transmitting or reflecting an ion beam in a mass spectrometer, the assembly comprising at least one electrode that is operable to provide a switchable electric field that, during a first mode of operation, directs an ion beam that enters the assembly along a first path so that the beam is transmitted through the assembly along the first path, and during a second mode of operation, directs an ion beam that enters the assembly along the first path so that the ion beam is reflected by the electric field and exits the assembly along a second path.

The invention can also be extended to a mass spectrometer that comprises a lens assembly according to the invention. In one such aspect a mass spectrometer is provided, comprising an ion source; at least one mass filter, for transmitting ions from the ion source; at least one electrostatic lens assembly, for selectively transmitting the ion beam along two distinct paths, the lens assembly being operable to provide a switchable electric field for directing an ion beam that enters the lens along a first path from the ion source, such that in a first mode of operation, the electric field selectively transmits the ion beam through the lens along the first path, and in a second mode of operation, the electric field reflects the ion beam along a second path, at least one mass analyzer, for analyzing ions that are transmitted and/or reflected in the lens assembly, and at least one detector, for detecting ions that are analyzed by the mass analyzer.

The invention furthermore relates to methods of mass spectrometry. In one such aspect the invention relates to a method of operating a mass spectrometer, the method comprising (a) transmitting an ion beam from an ion source through at least one mass filter, and (b) selectively directing the ion beam that is transmitted through the mass filter such that during at least one transmission period, ions in a first mass range that are transmitted by the first mass filter are directed along a first path, and during at least one scanning period, ions having at least one selectable mass-to-charge ratio that are transmitted by the mass filter are reflected and directed to a detector along a second path, wherein the mass-to-charge ratio of the reflected ions is scanned by the mass filter; wherein ions that are transmitted by the first mass filter during the transmission period are further transmitted to at least one mass analyzer, wherein the ions are separated by their mass-to-charge, and wherein the thus separated ions are detected by at least one detector.

In the present context, "reflection" and "reflecting" should be understood as the reversing with respect to the previous direction of travel. An ion beam that is reflected is thus reversed or redirected backwards with respect to its previous direction of travel. In a two-dimensional space, this means that the obtuse angle between a linear reflected beam and the corresponding linear incoming beam is greater than 90°.

The second path, at the exit from the assembly, can be directed sidewards and backwards with respect to the direction of the first path at its entry into the assembly. The second path can also be directed sidewards and backwards with respect to the direction of the first path at the separation point between the first and second path. An incoming ion beam can therefore enter the assembly along one path. The paths of such an ion beam during a transmission mode of the assembly, and during a reflection mode, are different within the lens due to different focusing and deflection actions along the two ion optical trajectories. The general direction of the second path, which is the direction of the beam during the reflection mode, can therefore be sidewards and backwards, i.e. the direction of the beam is in the opposite direction of the incoming beam and simultaneously towards the side of the assembly. This results in the beam being reflected sidewards in the assembly, i.e. the direction of the beam is towards the side and backwards, with respect to the direction of the incoming beam.

An ion moving through an electric field will migrate through the field based on its initial kinetic energy, its charge and the applied electric field. An electric field can be adjusted so as to alter the movement of an incoming beam of ions in any given direction and thereby either increase or decrease the energy of ions in the beam, by an adjustment of the electrical field surrounding the ions. In some cases, electric fields that are generated by applying a voltage to at least one electrode are used to direct positively charged ions in mass spectrometers. Such fields can be symmetrical in a longitudinal plane along the direction of an incoming beam of ions, which can result in the ions losing some of their kinetic energy while moving straight (linearly in case of a linear beam) through the electrical field. If the electrical field is asymmetrical with respect to the direction of the incoming ion beam, or asymmetrical in a longitudinal plane along the direction of the incoming ion beam, as well as being asymmetrical in a transverse plane to the direction of the incoming ion beam, the beam will be deflected by the electrical field. Thus, the electrical field can, depending on the mode of operation, be symmetric or asymmetric in a longitudinal and/or a transverse plane along the direction of motion of the first path. The electrical field can also be radially symmetrical or radially asymmetrical. In general, the three-dimensional nature of the electric field will determine the direction that an incoming beam of ions will move in, once within the field.

In some embodiments, the electric field during the first mode of operation can be symmetric with respect to the direction of motion of the incoming ion beam, and during the second mode of operation, the electric field within the assembly that reflects the ion beam along the second path can be asymmetric. The electric field can be symmetric in a longitudinal and/or a transverse plane along the direction of motion of the first path. The electric field can also be radially symmetrical along the first path, for example when at least one electrode in the lens assembly is radially symmetrical along the first path. It is also possible that the electric field during the first mode of operation be asymmetric with respect to the direction of the incoming beam.

As a result of the electrical field, the divergence of the transmitted and/or reflected beam along the first path and second paths, respectively is preferably reduced, and/or it matches the ion optical input requirements of following ion optics or detector within the instrument. More preferably, the electric field focuses the incoming ion beam, the reflected ion beam or both. Thus the ion beam can be focused within the electrostatic lens. The lens assembly can thus provide two functions: (1) the lens selectively directs an incoming ion beam along one of two distinct and separate paths, wherein one of the paths represents a reflection of the incoming ion beam and the other path represents a transmission of the ion beam, and (2) the lens reduces the divergence of, and/or focuses, the incoming (and transmitted) ion beam, the reflected ion beam, or both.

The first path of the ion beam and/or the second path of the ion beam may be linear. The paths can also be partially linear, i.e. the paths can include straight (linear) segments and curved segments.

In some preferred embodiments, the ion beam is a beam that is generated by an inductively coupled plasma (ICP). Other ion sources could be used, such as thermal ionisation or electron impact ionisation for example. The ion source preferably produces elemental ions for isotope ratio mass analysis.

In some embodiments, the angle between the first and second paths is in the range from about 100° to about 170°. The angle can also be in the range from about 120° to about 160°, from about 130° to about 150°, or from about 140° to about 150°. In some embodiments, the upper end of the range is from about 130° to about 170°, or from about 140° to about 160°. In some embodiments, the lower end of the ranges is in the range from about 100° to about 140°, or about 120° to about 130°. In some embodiments, the angle between the first and second path is in the range from 100 to 170°, from 120° to 160°, from 130° to 150°, or from 140° to 150°. In some embodiments, the angle is about 145°. The angle between the first and the second paths can be the obtuse angle, whereby the angle between the paths is zero if the paths are continuous, and the angle between the paths is 180° if the second path is completely reversed (mirrored) with respect to the first path. The angle between the paths can be the angle between the first path at its entry point into the lens assembly and the second path at its exit point from the assembly. In some cases, the first and/or the second paths are linear. It is also possible that the first and/or second path be curved, in which case the angle between the two can be the angle between tangents to the two paths. In some cases, the paths are partially linear and partially curved within the assembly.

In the first mode of operation, a first set of voltages is applied to electrodes in the lens assembly. A change of modes, from a transmission mode to a reflection mode, is effected by altering the voltages, such that a second set of voltages is applied to the electrodes.

In some embodiments of the lens assembly, the assembly comprises one or more electrodes that are arranged about the first path, the lens assembly having a first aperture and a second aperture, through which the ion beam is transmitted into and out of the assembly, along the first path, wherein the lens assembly further has a reflection aperture through which the beam is reflected out of the assembly, along the second path; and wherein the one or more electrode is arranged to generate an electric field for directing the ion beam within the lens, such that in a first mode, with a first set of one or more electric potentials being applied to the electrodes, the electrostatic lens assembly has an electrical field that selectively transmits the ion beam through the first and second apertures along the first path, and in a second mode, with a second set of one or more electric potentials being applied to the electrodes, the electrostatic lens assembly has an electric field that selectively reflects the ion beam that is transmitted through the first aperture along the second path through the reflection aperture.

The lens assembly can comprise at least two electrodes that are asymmetrical with respect to the first ion path. During the first mode of operation, the electric field generated by the electrodes can be symmetrical or it can be asymmetrical with respect to the incoming ion beam, although it is generally symmetrical. However, for achieving a reflection of the incoming ion beam, the electric field is asymmetric in the reflection mode, with respect to the incoming beam.

The electric potentials (voltages) applied to the electrodes can have identical or opposite polarities. In this context, the term "polarity" should be taken to mean the starting potential of the ions, i.e. the potential on which the ions are generated. In some embodiments, the voltages are of identical polarity. In general, transmission of the ion beam through the lens can be achieved using any combination of polarities of the electrodes in the lens. However, when operating in a reflection mode, preferably at least one of the electrodes has a repelling potential with respect to the starting potential for the ions. This means that during a reflection mode, for positively charged ions, at least one electrode has a positive potential, and for negative ions, at least one electrode has a negative potential. In some embodiments, the voltage of at least one electrode during the second, reflection mode of the lens is of opposite polarity to the polarity during the first transmission mode. For example, at least one electrode could have a positive voltage during reflection mode, while at least one other electrode could have a negative voltage.

In one preferred embodiment, wherein the lens assembly comprises two electrodes as described, the first electrode encountered by the ions (i.e. the upstream electrode of the pair of electrodes) can be held at a negative potential (preferably relatively high, e.g. in the range −1000V to −200V) for both modes, whereas the second (i.e. the downstream) electrode can be changed from about the same potential as the first electrode to a positive potential (preferably in the range +80V to +400V) when changing from transmission mode to reflection mode. These polarities are applicable to the case of positively charged ions. For the case of negatively charged ions, the aforementioned polarities of the electrodes would be reversed.

The electrode assembly can comprise one or more cylindrical or tubular electrodes. The assembly can comprise two or more cylindrical electrodes that are arranged and spaced apart along a first axis. The first axis can represent the center of an incoming ion beam along its first path into the assembly. The electrodes can be separated by a gap, wherein the electrodes are asymmetrical about the gap with respect to the ion beam along the first path. In a first mode, the at least two cylindrical electrodes can have the same or similar electrical potential applied to them to effect beam transmission, while in the second mode the electrodes can have different voltages, preferably different polarity voltages, applied to them to effect the beam reflection. The cylindrical electrodes with the first set of voltages applied in the first mode can generate an electric field having axial symmetry to effect the beam transmission and with the second set of voltages applied in the second mode the electrodes can generate an electric field not having axial symmetry to effect the beam reflection. The electrodes can in certain embodiments be coaxially arranged on the axis.

The reflection aperture, through which the reflected beam is transmitted in the assembly can be provided by an opening in at least one electrode, for example one cylindrical electrode. The reflection aperture can also be provided by a gap between two or more adjacent electrodes in the assembly.

The gap that separates the electrodes can be planar or non-planar. The gap is preferably arranged so that an angle between a normal vector to a tangential plane of the gap and the first path is not zero, and a normal vector to a tangential plane of the gap lies in a plane defined the first and the second path. The angle between a normal vector to the gap and a the first path can preferably not be zero. Preferably, the angle is in the range of about 5° to about 40°, preferably about 10° to about 30°, about 15° to about 25°, about 10° to about 25°, or about 10° to about 20°. The angle can be in the range of 10° to 40°, in the range of 10° to 30°, in the range of 10° to 25° or in the range of 10° to 20°.

The gap that separates the electrodes can comprise electrically insulating material, either partially or completely. In one embodiment, the gap comprises electrically insulating material, and the aperture for transmitting the reflected beam is provided by an opening through the insulating material. The insulating material can be any suitable ceramic or plastic insulator. The ceramic insulator can be for example steatite, cordierite, alumina, and/or zirconia. In addition to insulating the electrodes, the insulating material can furthermore provide mechanical stability to the lens assembly.

The lens assembly can include additional electrodes that provide additional guiding and/or focusing capabilities to the assembly. The additional electrodes can be arranged upstream or downstream from the central assembly of two or more electrodes that comprises the reflection functionality of the lens. In one embodiment, the assembly comprises at least one further electrode that is arranged upstream from the two electrodes. The assembly can also comprise at least one further electrode that is arranged downstream from the two electrodes. Preferably, the at least one further electrode has an aperture that is arranged on the first path in the assembly, i.e. the at least one further electrode has a further aperture that is on the first path such that the ion beam is directed through the aperture by the electrical field in the lens assembly. The additional electrodes can be any type of suitable electrodes, such as cylindrical electrodes and/or plate electrodes. For example, the additional electrodes can be at least one plate electrode that each has a further aperture that is arranged along the first path in the assembly. The aperture can be provided as an opening or hole in the electrode, for example as an opening through the plate electrode.

In one embodiment, there can be a first plate electrode upstream from the pair of electrodes, and second plate electrode, downstream from the pair of electrodes, the first and second plate electrode each being arranged to have a further aperture that is arranged on the first path.

The lens assembly can be configured to include at least one ion guide that is arranged along the first and/or second path. The ion guide electrodes can comprise at least one electrode of any suitable shape that will generate therein an electric field for directing the ion beam that is transmitted and/or reflected in the lens assembly. Preferably, the at least one electrode is electrically insulated from the electrodes that comprise a central lens element that generates the asymmetrical field within the assembly.

In some embodiments, the ion guide can be arranged to be positioned outwardly, i.e. in the direction away from, the lens assembly, i.e. away from the central lens electrodes that provide the reflecting functionality. The ion guide can be located downstream from the lens assembly along the transmitted path through the lens. The ion guide can also be located downstream from the lens, along the reflected path from the lens. The ion guide can comprise one or more cylindrical electrodes, which are preferably electrically insulated from the central lens electrodes that provide the reflecting functionality. The ion guide receives ions that are reflected in the lens assembly, and directs and preferably also focuses, or reduces the divergence of, an ion beam that is reflected in the lens into an adjacent component of a mass spectrometer. In a preferred embodiment, the component can for example be a detector which will detect ions that are reflected in the lens without any further mass selection or mass separation. Accordingly, the lens assembly can include at least one detector that is arranged downstream from the ion guide that receives a reflected ion beam in the lens assembly (or a transmitted beam, if the ion guide is located downstream along the transmitted path through the lens). The assembly can further include at least one deflector that deflects the ion beam from the ion guide into an off-axis detector. The reflected ion beam can thus be directed through an aperture/opening (exit hole) in the central lens assembly, such as by the first of the first of a pair of electrodes in the central assembly, and into an ion channel that forms the entrance path to a detector. The detector can be any type of detector that is typically used in mass spectrometry, such as an electron multiplier (continuous or discrete), also called SEM (Secondary Electron Multiplier) detector, an array detector, a Faraday cup, a photon counter, a scintillation detector, or any other detector that is useful for detecting ions, in particular in the context of a mass spectrometer. Preferably, the detector is capable of fast time response. The detector can therefore preferably be an electron multiplier, such as a continuous dynode multiplier or a discrete dynode multiplier.

By directing the reflected ions backwards, the lens assembly transmits reflected ions into a high-vacuum region of a typical mass spectrometer. For example, when arranged downstream from a mass filter that can preferably be a quadrupole assembly, the lens assembly can be arranged to reflect ions into an off-axis detector that is arranged adjacent to the mass filter, within a chamber that is operating at high vacuum. Accordingly, the lens assembly can be arranged to direct ions into a chamber that operates at different pressure to the electrostatic lens assembly, for example a chamber that operates at a pressure that is at least one order of magnitude higher or lower, preferably lower, than the pressure in the lens assembly. In general, the pressure within the lens assembly is in the range of $10^{-4}$ to $10^{-7}$ mbar, preferably in the range of $10^{-5}$ to $10^{-7}$ mbar. In some embodiments, the lens assembly is arranged to direct ions in one mode into a first chamber that operates at a pressure that is at least $10^{-5}$ mbar and preferably ranges from $5\times10^{-3}$ to $10^{-5}$ mbar, and in another mode into a second chamber that operates at a pressure not greater than $10^{-5}$ mbar, preferably that ranges from $10^{-5}$ to $10^{-7}$ mbar. The first chamber can be located downstream from the lens assembly, i.e. further away from the mass filter, and the second chamber can be located upstream from the assembly, i.e. closer to a mass filter, along the second path from the assembly. The first chamber can for example be a collision/reaction cell. The collision/reaction cell can operate at a pressure from about $5\times10^{3}$ to about $10^{-5}$ mbar. When a collision/reaction gas is provided in the cell, its pressure can be about $10^{-3}$ mbar, depending on the flow rate of the gas into the cell. For example, when reaction/collision gas is provided in the cell at a flow rate of about 1 mL/min, the pressure in the cell can be about $2\times10^{-3}$ mbar, and the pressure in the lens, when provided upstream from the collision cell can in such an arrangement be about $1\times10^{-5}$ mbar. When no gas is provided into the cell, the pressure in the cell can be about $10^{-5}$ mbar and the pressure in the lens can be about $5\times10^{7}$ mbar. The second chamber can preferably be a detector chamber. The detector chamber, which can preferably operate at a pressure of $10^{-6}$ to $10^{-7}$ mbar, can comprise further components, such as a mass filter. The mass filter upstream of the lens assembly and the second chamber (e.g. for housing the detector) preferably can be pumped to the same pressure, e.g. $10^{-5}$ to $10^{-7}$ mbar or $10^{-6}$ to $10^{-7}$ mbar.

Switching time between a normal (transmission) mode and a reflection mode of the electrostatic lens is preferably short. The switching time can be less than 10 ms, less than 5 ms, less than 4 ms, less than 3 ms, less than 2 ms, less than 1 ms, less than 0.5 ms, less than 0.2 ms or less than 0.1 ms. Preferably, the switching time is less than 1 ms. In some embodiments, the switching time is in the range of 0.1 to 10 ms, in the range of 0.5 to 5 ms, in the range of 1 to 10 ms, or in the range of 1 to 5 ms.

In some modes of operation, a reflected beam is not mass filtered prior to entering the detector. Optionally, mass filtering can be performed upstream from the reflection lens, such that the reflected ion beam that enters the off-axis detector and/or the transmitted ion beam, is representative of the mass selection of an upstream mass filter. For example, the lens assembly can be operated so that during the transmission mode, particles within a broad mass range are transmitted, representing a substantially non-m/z filtering mode. This means that ions are transmitted through the mass filter independent of their mass-to-charge ratio. During reflection mode, however, only ions with a certain mass-to-charge ratio are reflected, which can be the result of an upstream mass selection by a mass filter.

A mass filter can be a mass filter that comprises electrodes that are provided with a combination of RF and DC voltages in a mass-to-charge (m/z) filtering mode, and are provided with substantially only RF voltage in a non-filtering mode. In other words, the non-filtering mode is preferably an RF-only mode. In this mode, the ions are stable within the mass filter irrespective of their mass-to-charge ratio and as a consequence will be transmitted through it. It is possible that a small DC voltage be applied to the electrodes, in addition to the RF voltage, during the transmission mode. Preferably, the DC/RF voltage ratio in the non-filtering mode is 0.0 (i.e., RF only, no DC voltage), or no more than 0.001, or no more than 0.01, or no more than 0.05, or no more than 0.1. As a consequence, substantially only RF voltage should in the present context be taken to mean that the DC/RF ratio does not exceed these aforementioned values. Preferably, the DC/RF ratio is 0.0.

Preferably, the mass filter is a multipole filter. The electrodes of the filter are therefore preferably the rods of a multipole mass filter. The multipole can be a quadrupole, a hexapole, or an octapole. Preferably, the multipole is a quadrupole. The quadrupole can be a three-dimensional quadrupole or it can be a two-dimensional, i.e., linear, quadrupole. The rods of the multipole can be round rods, or they can be hyperbolic rods. In some embodiments, the multipole is a flatapole, in which the rods are flat, i.e. the rods have a flat surface.

The detector for detecting reflected particles can be placed upstream from the lens assembly, adjacent to an upstream mass filter, such as a quadrupole. Such an arrangement benefits from the superior vacuum in the vicinity of the mass filter, compared with a downstream arrangement, for example a detector arrangement that is near a collision cell, where vacuum conditions are relatively poor. As a consequence, superior detection conditions will be provided, irrespective of whether a downstream collision cell is being supplied with collision gas or not.

The setup has a further advantage that a mass spectrum of an incoming ion beam can be rapidly determined, using the first mass filter (e.g., a quadrupole operated in a scanning mode, i.e. changing the filtered m/z ratio of the ions), wherein during the reflection mode, the electrostatic lens is set to reflect the incoming ion beam backwards into the detector. During this time, a full mass spectrum, or a mass spectrum within a predetermined mass window, of an incoming ion beam can be determined by the detector used with the scanning mass filter. Such a scan can provide important information about the elemental composition of the sample being analyzed, which can for example be a sample of unknown composition (e.g. a meteorite sample)

and/or a sample with unknown isotope composition. Following the mass scan, which is very fast when the first mass filter is a multipole, a switch to the first transmission mode to direct the ions to a downstream mass analyzer can be performed, for example for determining isotopic composition of specific elements or molecular species in the sample. During this mode, the mass filter quadrupole can be set to transmit ions in a certain mass range, which is usually wide enough to simultaneously transmit all masses of interest, into a downstream mass analyzer, for example a multicollector mass analyzer for isotope ratio measurements. This setup has distinct advantages over present solutions, in which an ion beam has to be split, e.g. into two separate instruments, for different type of mass analysis in the two instruments.

The lens assembly can further include at least one voltage generator, for applying one or more voltages to the lens assembly. The lens assembly can further include at least one controller that is arranged to operate the lens assembly. For example, the controller can be adapted to operate the lens for a first period in a scanning mode, during which ions with one or more mass-to-charge ratios are reflected in the lens, the mass-to-charge ratios of the reflected ions being controlled by a mass filter that is located upstream of the lens assembly, and for a second period in a transmission mode, during which ions having a mass to charge ratio in a range that is substantially greater than during scanning mode are transmitted along the first path through the lens. During the first period, a full mass spectrum, or a partial mass spectrum, of a sample can be obtained, and during the second period, mass analysis of a selected mass range can be performed using a downstream mass analyzer, for example a sector field multicollector for determining isotope ratio of one or multiple elements.

The invention also provides a computer program having a program code to operate an electrostatic lens according to the invention. The computer program can preferably comprise a program code enabling the controller, when the program is executed on a computer of the controller, to operate the electrostatic lens. The program therefore can comprise code for enabling the controller to switch between a transmission mode and a reflection mode of the electrostatic lens. The invention also extends to a computer readable medium carrying the computer program. The computer medium is preferably readable by a computer so that the program can be executed on the computer.

The setup of having a single instrument analysing a single ion beam results in increased sensitivity and a full sample flow within a single instrument, as well as reduced cost and complexity. A critical consideration is the fact that the sample is ionized in the very same ICP source for both modes of operation, e.g. a full mass scan and an isotope ratio measurement. By contrast, in current split stream instruments, the sample is ionized in two independent ion sources and therefore analytical results may be different. Having a survey scan to detect the sample composition and an isotope ratio measurement based on identical sample composition due to both ion streams being formed in the very same ion source has analytical advantages with respect to the integrity of both data streams. The fast survey mass scan using the electrostatic lens in the reflection (mirror) mode can be interlaced with measurements using a conventional mass spectrometer, such as a multicollector instrument. Since multicollector instruments usually employ Faraday detectors, the effects of deflecting the ion beam for a short period of time (milliseconds) to do a mass scan does not appreciably affect the attainable precision required for isotope ratio analysis. The combined effect of determining elemental composition and determining isotope ratio with high precision, using the same sample, at the same time, and from the same analyte source (the same laser spot in case of laser ablation) vastly improves specificity of the analysis.

It will be appreciated that the relative positions of the detector for full scan acquisition and the collision cell/mass analyzer could be interchanged in other embodiments, i.e. wherein the detector is reached by the ion beam with the lens operated in transmission mode and the collision cell/mass analyzer is reached by the ion beam with the lens operated in reflection mode.

Accordingly, the invention also provides a mass spectrometer, comprising an ion source; at least one mass filter, for transmitting ions from the ion source; at least one electrostatic lens assembly, for selectively transmitting the ion beam along two distinct paths, the lens assembly being operable to provide a switchable electric field for directing an ion beam that enters the lens along a first path from the ion source, such that in a first mode of operation, the electric field selectively transmits the ion beam through the lens along the first path, and in a second mode of operation, the electric field reflects the ion beam along a second path; at least one mass analyzer, for analyzing ions that are transmitted and/or reflected in the lens assembly; and at least one detector, for detecting ions that are analyzed by the mass analyzer. The lens assembly operable with the mass spectrometer can be configured as described further herein.

The mass spectrometer can comprise at least one mass analyzer to analyze ions that are transmitted through the electrostatic lens along the first path, and at least one detector for detecting ions that are reflected by the electrostatic lens assembly along the second path. The electrostatic lens can result in focusing and/or reduced beam divergence of the ion beam that is transmitted and/or reflected in the lens.

In methods of operating a mass spectrometer according to the invention, there can be steps of transmitting an ion beam from an ion source through at least one mass filter; selectively directing the ion beam that is transmitted through the mass filter such that during at least one transmission period, ions in a first mass range that are transmitted by the first mass filter are directed along a first path, and during at least one scanning period, ions having at least one selectable mass-to-charge ratio that are transmitted by the mass filter are directed to a detector along a second path, wherein the mass-to-charge ratio of the reflected ions is scanned by the mass filter; wherein ions that are transmitted by the first mass filter during the transmission period are further transmitted to at least one mass analyzer, wherein the ions are separated by their mass-to-charge, and wherein the thus separated ions are detected by at least one detector.

The scanning period can preferably be short, e.g. less than about 20%, less than about 10%, less than about 5%, less than about 4%, less than about 3%, less than about 2%, or less than about 1% of the transmission period. When using laser ablation as a source of sample ions, the pulse strength is generally bell-shaped. This means that the period of scanning could be increased without appreciable affect the sensitivity of the downstream mass analysis for the transmission mode. For example, the scanning period could be as high as 50%, as high as 40% or as high as 30% during such operation. In general, the scanning period can be in the range of 0.5-50%, in the range of 1-40%, in the range of 1-30%, in the range of 1-20% or in the range of 1-10% of the transmission period.

The mass spectrometer can further comprise at least one collision cell. The collision cell can be arranged downstream from the electrostatic lens and configured to receive ions that are transmitted by the lens. The mass spectrometer can furthermore include at least one mass filter that is provided as a multipole assembly. The mass filter can be operable in a first filtering mode, for transmitting a portion of the ion beam having a selectable mass-to-charge ratio into the electrostatic lens, wherein the beam is reflected along the second path; and a second broad-mass mode, for transmitting ions of a mass range that is substantially greater than during filtering mode, wherein during the broad-mass mode the transmitted ion beam is transmitted through the lens assembly along the first path.

During transmission, the first mass filter can be adapted to only transmit ions within a range of predetermined mass-to-charge ratio. The transmitted ions can be selected to have a mass-to-charge ratio within a total range of no more than about 40 amu around a pre-defined ratio, preferably in a range of about 30, about 25, or about 20. It can thus be preferable to set the filter such that it does not transmit ions with a certain mass-to-charge ratio. For example, the mass filter can be set to transmit ions that are within a certain mass range. The mass range can be selected so that it does not include plasma gas ions, such as Argon ions, i.e. $^{40}Ar^{+}$. The first mass filter can also be operated in an RF-only mode, whereby there is effectively no mass discrimination by the mass filter.

In methods according to the invention, the ions can preferably be transmitted through a collision cell prior to being transmitted to the mass analyzer. Preferably, the transmission period is substantially greater than the scanning (reflection) period. For example, the duration of the at least one scanning period is less than about 20% of the at least one transmission period, such as less than about 10%, less than about 5%, less than about 3%, less than about 2%, less than about 1%, or less than about 0.5% of the at least one transmission period.

During the scanning period, the first mass filter can be adapted to transmit ions with a mass-to-charge ratio that is within a window of less than 1.0, preferably less than 0.8, less than 0.7 or less than 0.6 amu.

The methods according to the invention can also include a method that comprises steps of (i) transmitting the ion beam into the mass filter; (ii) during a scanning period, operating the mass filter so that ions within a plurality of mass ranges that each are less than 1 amu are sequentially transmitted by the mass filter, and selectively directing the thus transmitted ions along the second path, into at least one detector, so as to determine a mass spectrum; and (iii) during a transmission period, selectively directing ions that are transmitted by the first mass filter in a first mass range (preferably not mass-filtered, or mass-filtered with a substantially greater mass range than during the scanning period) along the first path, into at least one mass analyzer. There can be further steps comprising additional successive steps of operating the mass filter in a scanning mode, followed by operating the mass filter in a transmission mode. Preferably, each scanning period is less than 100 ms, preferably less than 50 ms. The switch between a scanning period and a transmission period is preferably performed in less than 20 ms, preferably less than 15 ms, more preferably less than 10 ms.

In some embodiments, the evaluation of a survey mass scan to provide information about sample composition could result in data dependent decisions. For example, based on the composition of a sample, a decision could be made as to which isotope system should be analyzed in the second mass analyzer and how long the measurement should take. In some embodiments, two or more isotopes systems can be measured wherein based on the survey scan results, the measurement time for each isotope system would be selected.

It is also possible to use the survey scan to reject samples for isotopic measurement based on the presence of a large amount of interference species found in the survey scan. In such embodiments, the isotopic measurement time can be set to zero and the instrument set to skip to the following sample to be analyzed.

It is also possible to add different gases to the plasma to match certain matrix compositions in order to eliminate or standardize matrix effects due to different sample compositions in the ICP source.

When the electrostatic lens according to the invention is used within a mass spectrometer that employs a collision cell, the lens can be set to transmission mode, for directing and focusing the ion beam into the collision cell. The collision cell can then be pressurized with appropriate gases and/or gas mixtures, depending on the analysis that is being performed. For example, He gas can be used as a source of collisions. Optionally, a further reactive gas can be added to introduce/stimulate chemical reactions within the collision cell. For example, by adding oxygen gas to the cell, certain elements will be converted into the corresponding oxides. Other reactive gases that can be used include $NH_3$, $SO_2$ and $H_2$.

The electrostatic lens can be arranged upstream from a collision cell, between the collision cell and the ion source. For example, the lens can be arranged between a mass filter and a collision cell. The lens can also be arranged downstream from a collision cell, for example between a collision cell and a mass analyzer. In one use of such a configuration, a full mass spectrum of ions passing through the collision cell can be obtained, as well as an isotope composition analysis by a downstream mass analyzer, such as a sector multicollector instrument.

After the ions have passed through the collision cell, they can be accelerated using a high voltage to be focused in the ion optics of a downstream mass filter, for example in a double focusing high resolution multicollector mass spectrometer, for the simultaneous measurement of all isotopes of a particular species of interest. In some embodiments, the multicollector mass spectrometer can cover about 16% relative mass dispersion along the focal plane. In some embodiments, the mass analyzer may be of another type, e.g. a single-collector sector field mass analyzer, or a quadrupole mass analyzer.

A combination of Faraday cups and ion counters can be installed in the detector of the multicollector instrument. For example, 9 Faraday cups in addition to up to 8 ion counters can be installed. The axial channel can be equipped with a switchable collector channel behind the detector slit, where the ion beam can be switched between a Faraday cup and an ion counting detector. On each side of this fixed axial channel, there can be four moveable detector platforms, each of which can carry one Faraday cup and attached to it one or more miniaturized ion counting channels. Every second platform can be motorized and adjusted using a computer operated controller. The detector platforms between two motorized platforms can be pushed or pulled into position by one or two of the adjacent platforms, allowing for full position control on all moveable platforms.

The above features along with additional details of the invention are described further in the examples below, which are intended to further illustrate the invention but are not intended to limit its scope in any way.

BRIEF DESCRIPTION OF THE DRAWINGS

The skilled person will understand that the drawings, described below, are for illustration purposes only. The drawings are not intended to limit the scope of the present teachings in any way.

DESCRIPTION OF VARIOUS EMBODIMENTS

In the following, exemplary embodiments of the invention will be described, referring to the figures. These examples are provided to provide further understanding of the invention, without limiting its scope.

In the following description, a series of steps are described. The skilled person will appreciate that unless required by the context, the order of steps is not critical for the resulting configuration and its effect. Further, it will be apparent to the skilled person that irrespective of the order of steps, the presence or absence of time delay between steps, can be present between some or all of the described steps.

It should be appreciated that the invention is applicable for isotope analysis of materials in general, such as gases, liquids, solids, particles and aerosols. In general, therefore, the sample that is being analyzed in the system will be variable.

Figure 1A:
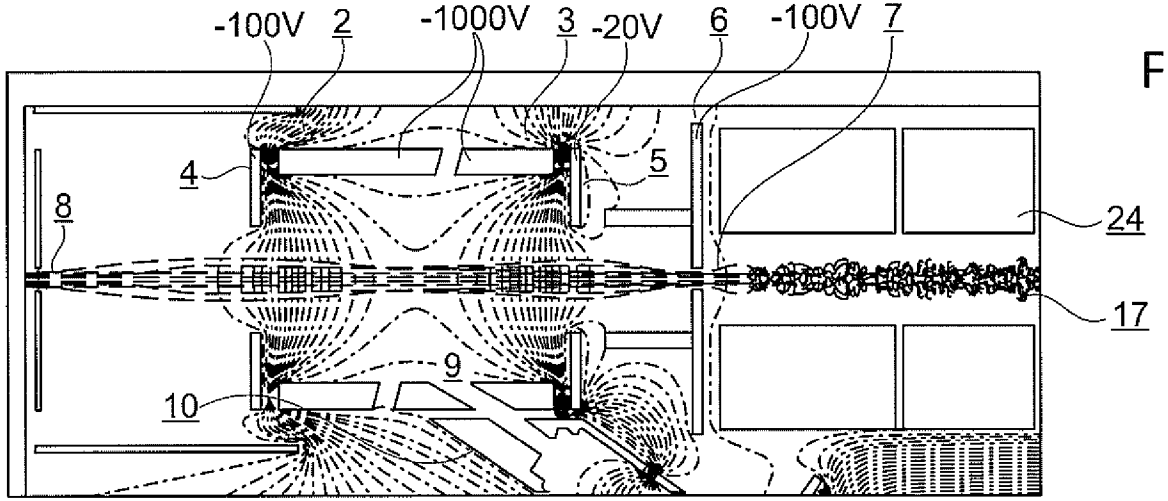
FIGS. 1A and 1B show schematic cross-sectional views of an electrostatic lens according to the invention wherein, in FIG. 1A, the lens is shown in transmission mode, and in FIG. 1B the lens is shown in reflection mode.
Figure 1B:
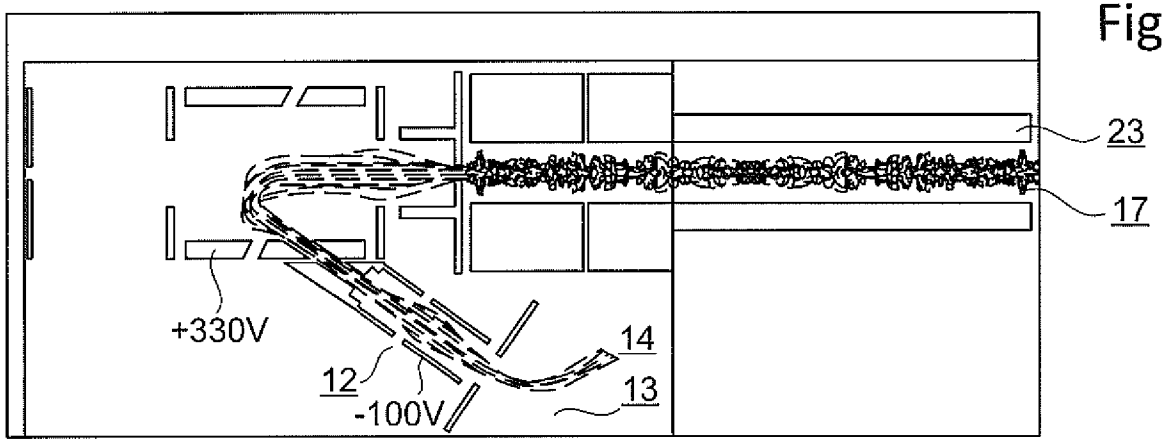
Figure 4:
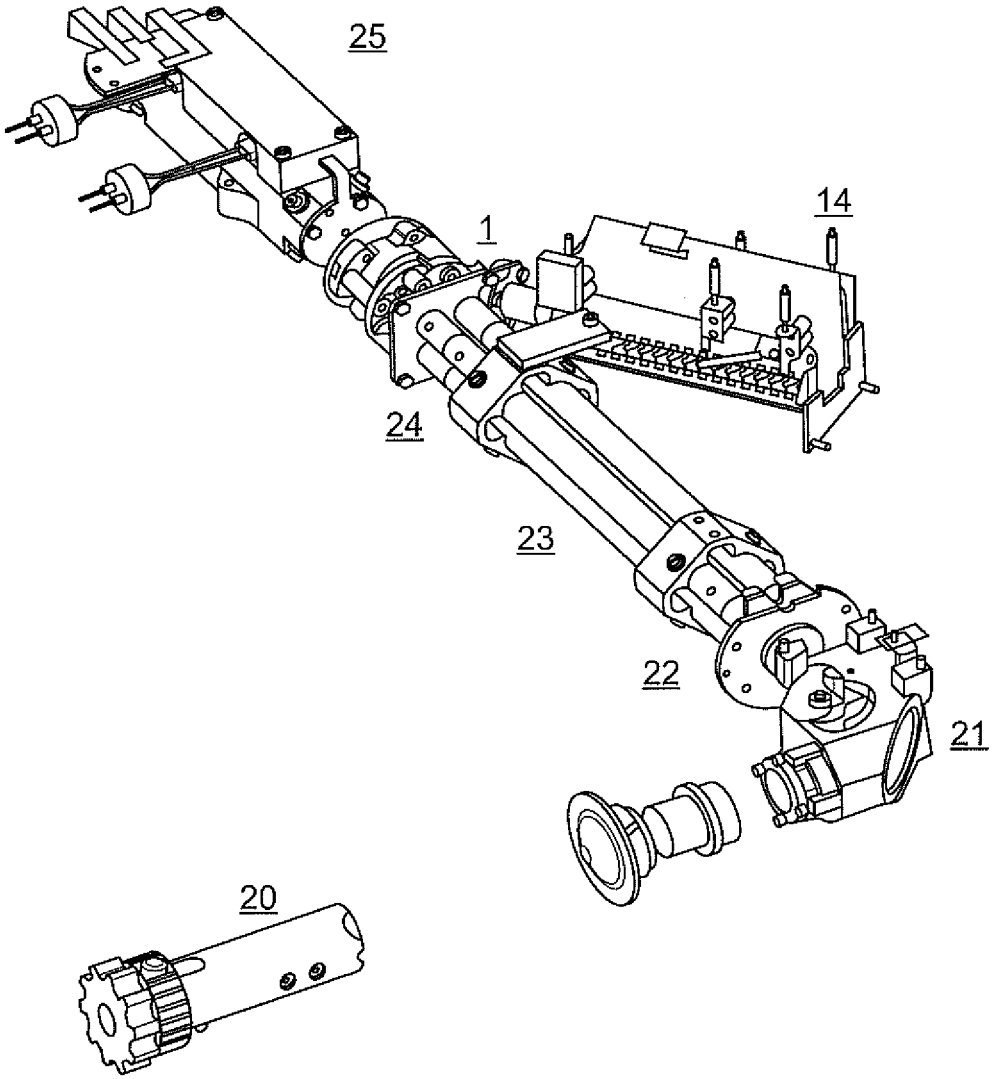
FIG. 4 shows a partial mass spectrometer assembly, showing an ion source, mass filter, electrostatic lens according to the invention, and a collision cell downstream of the electrostatic lens.

Referring to FIGS. 1A and 1B, there are shown cross-sectional views through the center of a cylindrical lens assembly according to the invention, indicated with a general numerical reference 1. The lens assembly is arranged downstream from a quadrupole 23, also shown in FIG. 4 and FIG. 5, that can be operated as a mass filter and which is followed by an RF-driven post-filter section 24. The post-filter section, and a corresponding RF-driven pre-filter section 22 that is arranged in front of the quadrupole, ensure efficient beam transport so that a flat mass response across a selected mass range is obtained.

Also indicated in FIG. 1A are equipotential lines for the electrical field in the lens during transmission mode. With the applied voltages indicated, the electrical field is symmetrical in a longitudinal plane along the direction of the ion beam. Due to the cylindrical geometry of the assembly, the field is also radially symmetrical along the direction of the beam.

An ion beam 17 is directed by the post-filter section 24 and through an entrance aperture 7 on a plate electrode 6 that represents the entrance to the electrostatic lens 1. The lens assembly includes further circular plate electrodes 4, 5 and a central lens element comprising two electrodes 2, 3 that are asymmetric with respect to the incoming ion beam, and are separated by a gap 15 that lies in a plane that is not perpendicular to the incoming ion beam, i.e. the angle between a normal vector to the plane and the ion beam is not zero. In FIG. 1A the path of the ion beam is shown when the lens assembly is operated in a transmission mode, driven by an equal voltage of −1000V that is applied to the central lens elements 2, 3, resulting in a symmetrical electric field within the assembly that results in transmission of the incoming ion beam 17. The divergence of the ion beam is decreased as it passes through the lens assembly, i.e. the beam has increased focus, where it is transmitted to downstream elements of the mass spectrometer, through an exit aperture 8 on a plate electrode that represents the exit of the electrostatic lens in transmission mode.

In FIG. 1B, the lens assembly is shown when operated in a reflection mode. Here, the voltage applied to the two central lens elements 2, 3 has been altered, such that electrode 2 is now operating at +330V, while electrode 3 is maintained at −1000V, resulting in an asymmetrical electric field in the lens assembly. As a result of the asymmetrical field, an incoming ion beam 17 is reflected backwards and sideways in the space within the central lens elements (electrodes 2 and 3), and is directed through a reflection aperture 9 on the first central lens electrode 3. The beam is subsequently transmitted through an ion guide 12 and deflected by a deflector 13 to a downstream off-axis detector 14.

Thus, the first electrode is maintained at a relatively high negative potential of −1000V for both modes, whereas the second electrode is switched from being about the same potential as the first electrode to a positive potential of about +330V when going from transmission mode to reflection mode. The positive ions are in this case generated at about 0V starting potential. In general, for this configuration, the first electrode could be operated at a negative potential of −1000V to −200V during both modes, while the second electrode could be switched from being at about the same potential as the first electrode to a positive potential of about +80V to about +400V when switching from transmission mode to reflection mode.

As a result of the dual-mode operation of the lens assembly, an incoming ion beam can in a first mode be transmitted through the assembly, and simultaneously the divergence of the beam is decreased. In a second mode, the beam is prevented from being transmitted through the assembly, and is instead reflected through an aperture to an off-axis detector (not shown). One advantage of the placement of the detector adjacent to an upstream mass filter quadrupole, is that the detector is located in a high-vacuum region of the mass spectrometer, leading to decreased noise and resulting increased sensitivity of the detector. The lens therefore has two modes, a transmission mode and a reflection mode. During operation, the lens focuses (decreases the divergence of) the ion beam, to increase the transmission of the beam, both in transmission and reflection modes.

Figure 2:
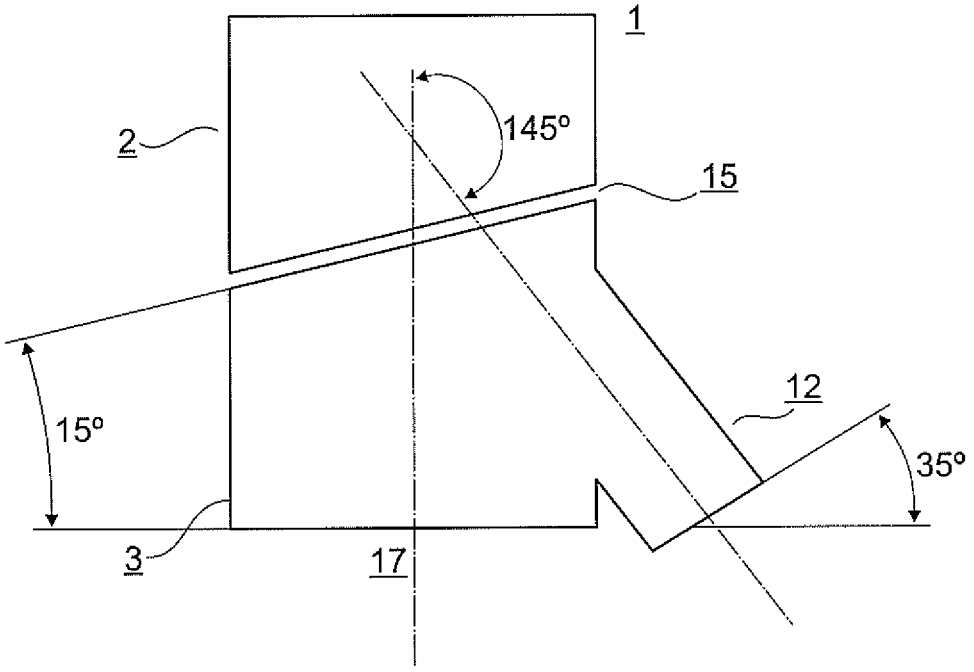
FIG. 2 shows a schematic cross-sectional view of an electrostatic lens according to the invention.

In FIG. 2, a schematic representation of the geometry of the central lens electrodes 2, 3 is shown. The path of an incoming and reflected ion beam 17 is schematically indicated by straight lines that define two axes of travel. The obtuse angle between the two axes in this configuration is 145°, which is a result of the asymmetrical lens assembly configuration. The angle between a normal vector to a plane defined by the gap 15 that separates the two central electrodes and the incoming beam is 15°. The resulting asymmetric electric field, when a positive voltage is applied to the second electrode 2, while maintaining a negative voltage on the first electrode 3, results in an electric field that is capable of reflecting an incoming ion beam into an off-axis detector, through an ion guide 12.

Figure 3A:
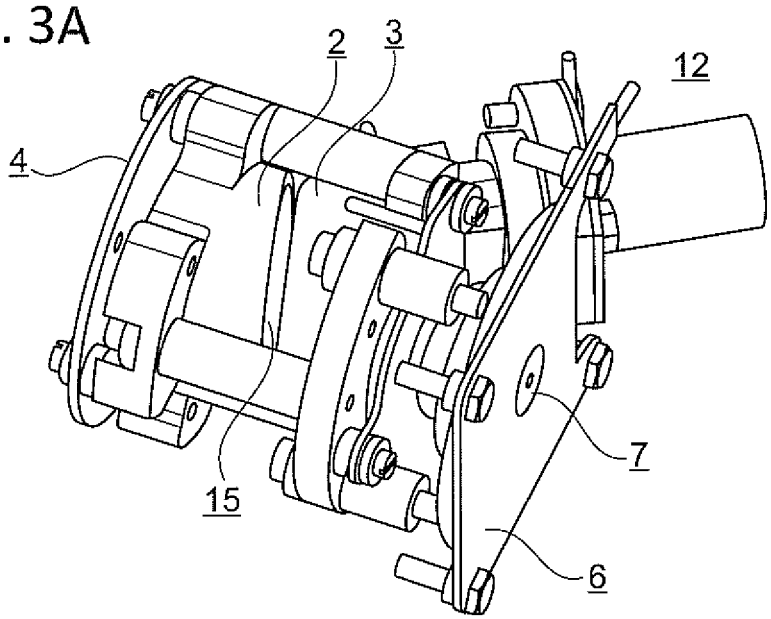
FIGS. 3A and 3B show views of an electrostatic lens according to the invention.
Figure 3B:
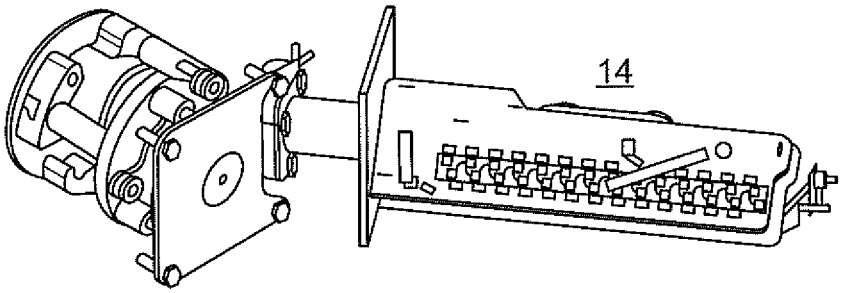

Turning to FIG. 3A, a view of a lens assembly according to the invention is shown. The central lens element comprises two tubular electrodes 2, 3 that are separated by a gap 15. Plate electrodes 4, 6 are arranged at the downstream and upstream end of the assembly, respectively. Also indicated is an ion guide 12, through which a reflected ion beam is directed when the lens assembly is operated in a reflection mode. A secondary electron multiplier (SEM) detector 14 is arranged behind the ion guide, as shown in FIG. 3B.

The lens assembly can be accommodated in a mass spectrometer, where it is desirable to be able to switch an incoming ion beam between two axes of travel. An example of one such arrangement is indicated by the partial mass spectrometer assembly shown in FIG. 4. Downstream from an inductively coupled plasma (ICP) source 20, a deflection lens 21 is arranged, and which serves to remove neutral particles from the ion beam generated in the ICP source. The beam subsequently enters a quadrupole 23 which is flanked by pre- and post-filter elements 22, 24. The quadrupole can be operated in a mass filtering mode, whereby only masses with a defined mass-to-charge ratio are transmitted. The quadrupole can also be transmitted in an RF-only mode, so as to effectively transmit all incoming ions. Following the quadrupole, there is an electrostatic lens assembly 1, for example an assembly as shown in FIGS. 3A and 3B, that is operable to transmit an incoming ion beam into a downstream collision cell 25 or alternatively reflect the ion beam into an off-axis detector 14.

The transmission efficiency of the electrostatic lens is quite high. Thus, transmission efficiency to the off-axis detector during the reflection mode can be as high as 60-70%. This is important for sensitivity, for example when analysing samples that are only available in minute quantities.

In a scanning mode, the quadrupole can be set to sequentially transmit ions within a small size range such as 0.7 amu, and the ions thus transmitted can be reflected in the lens 1 and detected by the off-axis detector 14. The quadrupole can very quickly scan across a large number of masses, and a full mass spectrum can therefore be obtained in about 50 to 100 ms or less. This scanning mode can be very useful, for example when samples of unknown composition are analyzed. The scanning mode can also provide information about the purity of the sample that is being analyzed. This setup has the advantage over instruments that require the gas stream be split for analysing specific mass ranges in one mass analyzer, and obtaining a full mass spectrum on another mass analyzer, that the beam from a single sample is analyzed to obtain both a full mass spectrum and a specific mass analysis, such as an isotope ratio. The incoming beam is only transiently reflected to the off-axis detector to obtain a full mass spectrum, with the large majority of the beam, and thus the sample, being used to perform a mass-specific analysis in the downstream mass analyzer, such as obtaining an isotope ratio measurement. Following a full spectrum scan, the lens assembly can thus be set to transmit ions through the lens. The switch between reflection mode and transmission mode can be performed very quickly, or in about 10 ms or less. During the transmission mode, the ion beam is transmitted into the collision cell 25. The quadrupole can in this mode be set to transmit all masses, by setting the quadrupole to an RF-only mode. Alternatively, the quadrupole can be set to only transmit masses within a certain range.

The collision cell can be pressurized with different gases, or mixtures of gases, to stimulate desirable chemistry in the cell that is useful for any particular analysis being done, such as reaction with a collision gas to remove interferences, or reaction with oxygen to form oxides.

It can be useful to be able to eliminate Ar ions from the beam. These ions are a major component of the ion beam in an ICP, and can lead to significant ionization of gas in the collision cell. This can lead to interferences on the analysis in the downstream mass analyzer, for example during isotope ratio determination. Removing the $^{40}$Ar portion of the incoming ion beam can therefore lead to significantly reduced interference in the collision cell, and increased sensitivity as a consequence. Accordingly, a range can be chosen that eliminates the mass of the plasma gas, such as $^{40}$Ar.

In one mode of operation, the dual-mode lens is arranged in an isotope ratio instrument. For such analysis, it can be desirable to select only masses in a defined range, and transmit only those masses to the collision cell and a downstream mass analyzer. The mass filter can therefore be set to transmit only a certain mass range, for example a mass range that covers only isotopes of one, or a few, elements. For example, during an analysis of mass 100, a mass size window of 90 to 110 might be desirable, or a mass window of about 27 to 33 for a mass of 30. In general, it can be desirable to transmit ions in a range that is about 10 to 20% of the mass being analyzed.

Figure 5:
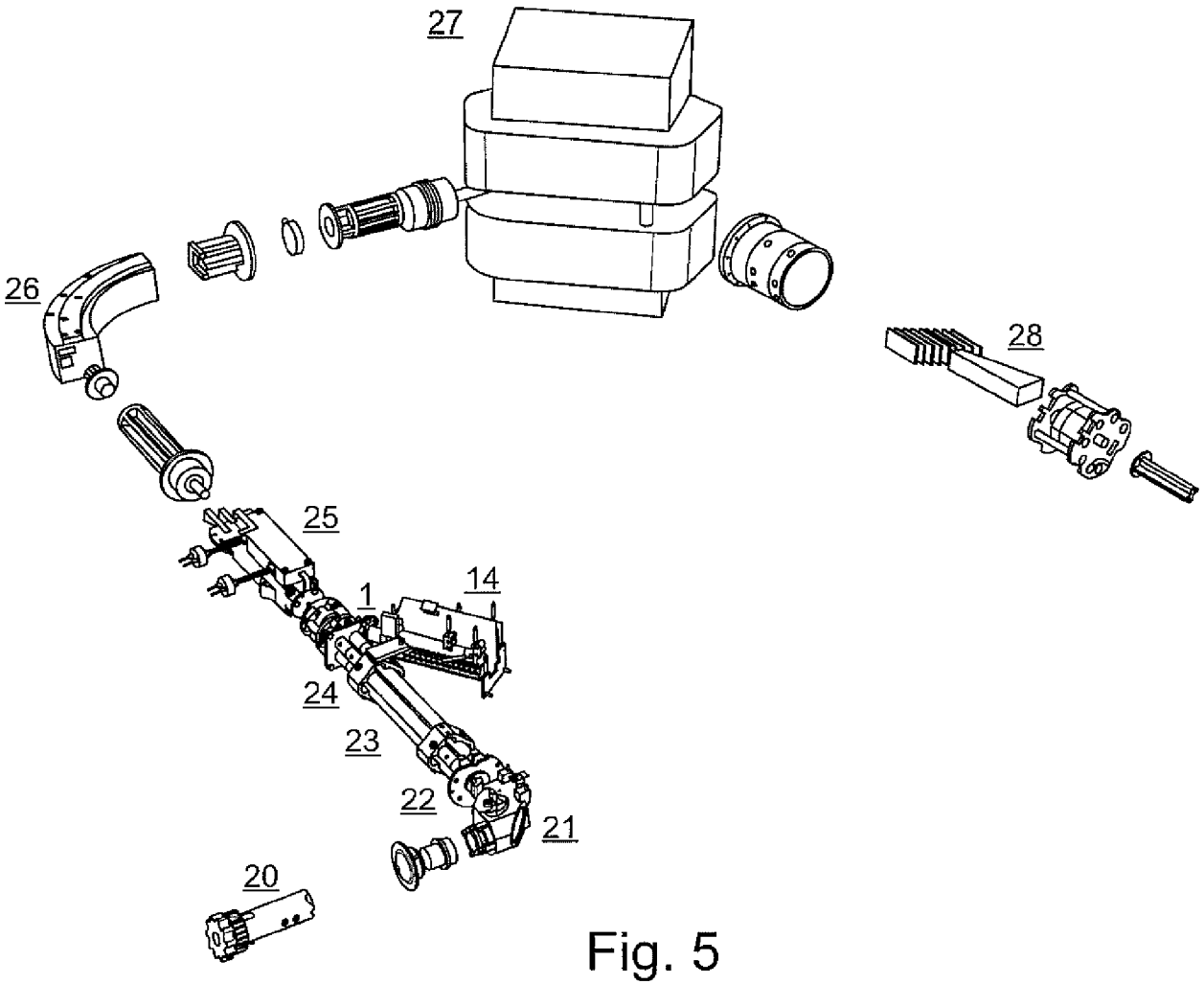
FIG. 5 shows a schematic overview of a mass spectrometer employing an electrostatic lens in accordance with the invention.

One example of a mass spectrometer that includes an electrostatic lens according to the invention is shown in FIG. 5. Here, a double focusing multicollector inductively coupled plasma mass spectrometer (ICP-MS) is shown. The instrument has an ICP source 20 and a deflection lens 21 arranged upstream from a quadrupole mass filter 23, a dual-mode reflection lens 1, and a collision cell 25. Downstream from the collision cell is a mass analyzer that comprises an electric sector 26 and a magnetic sector 27, followed by a multicollector detector assembly 28.

An advantage of the configuration of this setup is the placement of the detector 14 for detecting ions that are reflected in the lens assembly 1, adjacent to the quadrupole. The pressure in this region of the instrument is significantly lower (i.e., higher vacuum) than within the chamber surrounding the downstream collision cell, or near the ICP source. As a consequence, noise at the off-axis detector 14 can be kept to a minimum.

It should be apparent to the skilled person that the electrostatic lens according to the invention can be arranged in mass spectrometers with different configurations. For example, it is possible that components that are arranged downstream of transmitted and reflected beams be reversed, i.e. such that a detector is placed immediately downstream of the lens, for detecting transmitted particles, and that other components, such as a collision cell and a further mass analyzer be arranged for receiving a beam that is reflected in the lens.

In another configuration there can also be a second, or an alternate, reflection lens assembly according to the present invention positioned behind (downstream from) the collision cell but in front of a sector mass analyzer. Such a configuration would allow the recordation of a mass spectrum of ions that have passed through the collision cell, in addition to ions from the ICP source. This can be useful for example for analyzing molecular adducts and/or fragments that are generated within the collision cell.

The skilled person will appreciate that the reflection lens can in general be used in other suitable configurations in a mass spectrometer, where it is useful to be able to divert a flow of incoming ions along two distinct and separate paths, for performing individual downstream analyzes. Thus, although some specific utilities of the lens have been described and illustrated by the foregoing exemplary configurations, the lens has general utility as a selective ion-guide that is capable of rapidly and efficiently transmitting an incoming ion beam along two distinct paths.

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components.

The present invention also covers the exact terms, features, values and ranges etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

The term "at least one" should be understood as meaning "one or more", and therefore includes both embodiments that include one or multiple components. Furthermore, dependent claims that refer to independent claims that describe features with "at least one" have the same meaning, both when the feature is referred to as "the" and the "at least one".

It will be appreciated that variations to the foregoing embodiments of the invention can be made while still falling within the scope of the invention can be made while still falling within scope of the invention. Features disclosed in the specification, unless stated otherwise, can be replaced by alternative features serving the same, equivalent or similar purpose. Thus, unless stated otherwise, each feature disclosed represents one example of a generic series of equivalent or similar features.

Use of exemplary language, such as "for instance", "such as", "for example" and the like, is merely intended to better illustrate the invention and does not indicate a limitation on the scope of the invention unless so claimed. Any steps described in the specification may be performed in any order or simultaneously, unless the context clearly indicates otherwise.

All of the features and/or steps disclosed in the specification can be combined in any combination, except for combinations where at least some of the features and/or steps are mutually exclusive. In particular, preferred features of the invention are applicable to all aspects of the invention and may be used in any combination.

The invention claimed is:

1. An electrostatic dual-mode lens assembly for selectively transmitting or reflecting an ion beam in a mass spectrometer, the assembly comprising at least two cylindrical electrodes that are arranged and spaced apart along a first path and are separated by a gap such that the electrodes are asymmetric about the gap, and wherein the electrodes are operable to provide a switchable electric field that, during a first mode of operation, directs an ion beam that enters the assembly along a first path so that the beam is transmitted through the assembly along the first path, and during a second mode of operation, directs an ion beam that enters the assembly along the first path so that the ion beam is reflected by the electric field and exits the assembly along a second path, wherein the angle between the first and the second paths is in the range from about 100° to about 170°.

2. The lens assembly of claim 1 wherein the second path, at the exit from the assembly, is directed sidewards and backwards with respect to the direction of the first path at its entry into the assembly.

3. The lens assembly of claim 1, wherein the electric field during the first mode of operation is symmetric with respect to the direction of motion of the incoming ion beam, and during the second mode of operation, the electric field within the assembly that reflects the ion beam along the second path is asymmetric.

4. The lens assembly of claim 1, wherein the lens assembly has a first aperture and a second aperture, through which the particle beam is transmitted into and out of the assembly, along the first path, wherein the lens assembly further has a reflection aperture through which the beam is reflected out of the assembly, along the second path; and wherein the at least two cylindrical electrodes are arranged to generate an electric field for directing the ion beam within the lens, such that in a first mode, with a first set of one or more voltages being applied to the at least two cylindrical electrodes, the electrostatic lens assembly has an electrical field that selectively transmits the ion beam through the first and second apertures along the first path, and in a second mode, with a second set of one or more voltages being applied to the at least two cylindrical electrodes, the electrostatic lens assembly has an electric field that selectively reflects the ion beam that is transmitted through the first aperture along the second path through the reflection aperture.

5. The lens assembly of claim 4, wherein the reflection aperture is provided by a gap between at least two electrodes in the lens assembly or by an opening in at least one electrode, through which the ion beam is reflected in the assembly.

6. The lens assembly of claim 5, wherein the gap between the two electrodes is planar or non-planar, and wherein the angle between a normal vector to a tangential plane of the gap and the first path is not zero and a normal vector to a tangential plane of the gap lies in a plane defined by the first and the second path.

7. The lens assembly of claim 5, wherein the gap between the electrodes comprises electrically insulating material.

8. The lens assembly of claim 1, wherein the at least two cylindrical electrodes have the same voltage applied to them in the first mode to effect the beam transmission and have different voltages applied to them in the second mode to effect the beam reflection.

9. The lens assembly of claim 1, wherein the at least two cylindrical electrodes with the first set of voltages applied in the first mode generate an electric field having axial symmetry to effect the beam transmission and with the second set of voltages applied in the second mode generate an electric field not having axial symmetry to effect the beam reflection.

10. The lens assembly of claim 1, wherein the at least two cylindrical electrodes are coaxially arranged on the first path.

11. The lens assembly of claim 1, wherein the assembly comprises at least one further electrode that is arranged upstream from the two electrodes and/or at least one further electrode that is arranged downstream from the two electrodes.

12. The lens assembly of claim 1, further comprising at least one ion guide that is arranged downstream from the lens assembly, along the first and/or second path, wherein the ion guide generates therein an electric field for directing the ion beam that is reflected and/or transmitted in the lens assembly.

13. The lens assembly of claim 12, further comprising at least one detector that is arranged downstream from the ion guide.

14. The lens assembly of claim 13, wherein the lens assembly is provided in a mass spectrometer.

15. The lens assembly of claim 13, wherein the lens assembly is arranged to direct ions into a first and second chamber operating at different pressure to the electrostatic lens assembly, such that the ratio of pressure in the two chambers is at least 10.

16. The lens assembly of claim 15, wherein the lens assembly is arranged to direct ions into a first chamber that operates at a pressure that ranges from $5\times10^{-3}$ to $10^{-5}$ mbar, and a second chamber that operates at a pressure that ranges from $10^{-5}$ to $10^{-7}$ mbar.

17. The lens assembly of claim 16, wherein the detector is arranged in the second chamber operating at a pressure of $10^{-6}$ to $10^{-7}$ mbar.

18. The lens assembly of claim 1, further comprising at least one controller that is adapted to operate the lens for a first period in a scanning mode, during which ions with one or more mass-to-charge ratios are reflected in the lens, the mass-to-charge ratios of the reflected ions being controlled by a mass filter that is located upstream of the lens assembly, and for a second period in a transmission mode, during which ions having a mass to charge ratio in a range that is substantially greater than during scanning mode are transmitted along the first axis through the lens.

19. A mass spectrometer, comprising:

a) an ion source;

b) at least one mass filter, for transmitting ions from the ion source;

1) at least one electrostatic lens assembly, for selectively transmitting the ion beam along two distinct paths, the lens assembly being operable to provide a switchable electric field for directing an ion beam that enters the lens along a first path from the ion source, such that in a first mode of operation, the electric field selectively transmits the ion beam through the lens along the first path, and in a second mode of operation, the electric field reflects the particle beam along a second path, wherein the angle between the first and the second paths is in the range from about 100° to about 170°;

2) at least one mass analyzer, for analyzing particles that are transmitted and/or reflected in the lens assembly; and 3) at least one detector, for detecting particles that are analyzed by the mass analyzer.

20. The mass spectrometer of claim 19, comprising at least one mass analyzer to analyze ions that are transmitted through the electrostatic lens along the first path, and at least one detector for detecting ions that are reflected by the electrostatic lens assembly along the second path.

21. The mass spectrometer of claim 19, further comprising at least one collision cell that is arranged downstream from the electrostatic lens and is configured to receive ions that are transmitted by the lens.

22. A method of operating a mass spectrometer, the method comprising a) transmitting an ion beam from an ion source through at least one mass filter; and b) selectively directing the ion beam that is transmitted through the mass filter such that 1) during at least one transmission period, ions in a first mass range that are transmitted by the first mass filter are directed along a first path, and 2) during at least one scanning period, ions having at least one selectable mass-to-charge ratio that are transmitted by the mass filter are directed to a detector along a second path, wherein the mass-to-charge ratio of the reflected ions is scanned by the mass filter, and wherein the angle between the first and the second paths is in the range from about 100° to about 170°;

wherein ions that are transmitted by the first mass filter during the at least one transmission period are further transmitted to at least one mass analyzer, wherein the ions are separated by their mass-to-charge, and wherein the thus separated ions are detected by at least one detector.

23. The method of claim 22, wherein the ions are transmitted through a collision cell prior to being transmitted to the mass analyzer.

24. The method of claim 22, wherein during the transmission period, the first mass filter is adapted to only transmit ions within a range of predetermined mass-to-charge ratio, such that transmitted particles have a mass-to-charge ratio within a total range of no more than about 40 around a pre-defined ratio.

25. The method of claim 22, further comprising:

a) transmitting the ion beam into the mass filter;

b) operating the mass filter so that ions within a plurality of mass ranges that each are less than 1 amu are sequentially transmitted by the mass filter, and selectively directing the thus transmitted ions along the second path, into at least one detector, so as to determine a mass spectrum;

c) during a transmission period, selectively directing ions that are transmitted by the first mass filter in a first mass range along the first path, into at least one mass analyzer.

26. The method of claim 23, wherein the collision cell is pressurized with at least one gas to promote fragmentation and/or mass shift of ions in the ion beam.

* * * * *